US007352976B2

(12) United States Patent
Balch et al.

(10) Patent No.: US 7,352,976 B2
(45) Date of Patent: Apr. 1, 2008

(54) IMAGING CARTRIDGE STATUS INDICATOR

(76) Inventors: Debbie A. Balch, 1411 E. Lewis, Boise, ID (US) 83712; Santiago Rodriguez, 1655 S. Wind Dancer Way, Boise, ID (US) 83712

( * ) Notice: Subject to any disclaimer, the term of this patent is extended or adjusted under 35 U.S.C. 154(b) by 124 days.

(21) Appl. No.: 10/977,310

(22) Filed: Oct. 29, 2004

(65) Prior Publication Data

US 2006/0093384 A1 May 4, 2006

(51) Int. Cl.
*G03G 15/08* (2006.01)

(52) U.S. Cl. ..... 399/27; 299/262

(58) Field of Classification Search ..... 399/24, 399/27, 107, 119, 262
See application file for complete search history.

(56) References Cited

U.S. PATENT DOCUMENTS

| | | | | |
|---|---|---|---|---|
| 5,594,535 | A * | 1/1997 | Beaufort et al. | 399/262 |
| 5,923,918 | A * | 7/1999 | Nakagawa et al. | 399/27 |
| 6,959,156 | B2 * | 10/2005 | Ogata | 399/27 |
| 2004/0027430 | A1 * | 2/2004 | Anderson et al. | 347/86 |

* cited by examiner

*Primary Examiner*—Sandra L. Brase

(57) ABSTRACT

An imaging cartridge includes a housing having a reservoir for holding a supply of imaging material. The housing can be inserted into an imaging device and includes an indicator window. A status indicator contained within the housing is configured to be made visible through the indicator window following a triggering event.

15 Claims, 7 Drawing Sheets

IMAGING CARTRIDGE STATUS INDICATOR

BACKGROUND

Imaging devices such as laser printers consume toner, ink, and other imaging materials to form printed images. Imaging materials, often referred to as consumables, are often supplied via replaceable imaging cartridges. When, through use, the imaging material is depleted, the imaging cartridge can be replaced. Using sensors and estimation algorithms, an imaging device, can alert a consumer when imaging material is running low or has been depleted. This alert is typically provided though a control panel provided by the imaging device or a user interface displayed on a computer connected to the imaging device.

Unfortunately, these alerts are only available when the toner cartridge is inserted in the imaging device. It is not uncommon for a consumer to believe that he has received such an alert in error due to a defective cartridge and to return the cartridge to a retailer for replacement. Absent inserting the suspect cartridge into a compatible imaging device, the retailer has no mean for truly determining if the cartridge is defective or has simply reached the end of its useable life and is out of warranty.

DETAILED DESCRIPTION

Various embodiments provide a status indicator for an imaging cartridge. A status indicator can be any object that, when visible to the human eye, can signify a particular status of the imaging cartridge. For example, a visible status indicator may suggest that the useful life of the imaging cartridge has expired. The expiration of the useful life may but need not mean that the imaging cartridge will no longer function. It may simply mean that the cartridge has been used to the extent for which it was designed.

A status indicator is configured to be made visible following the occurrence of a triggering event. The useful end-of-life of an imaging cartridge, for example, may be determined to expire upon one or more triggering events. As examples, a triggering event can include the consumption of a substantial amount of the cartridge's imaging material. It can include the use of the imaging cartridge to print a specified number of pages or the use of a cartridge component through a specified number of cycles. In a specific implementation, a status indicator can be used to provide a visible signal to a consumer and retailer that the imaging cartridge has performed as designed and is out of warranty.

Imaging Cartridge

Figure 1:
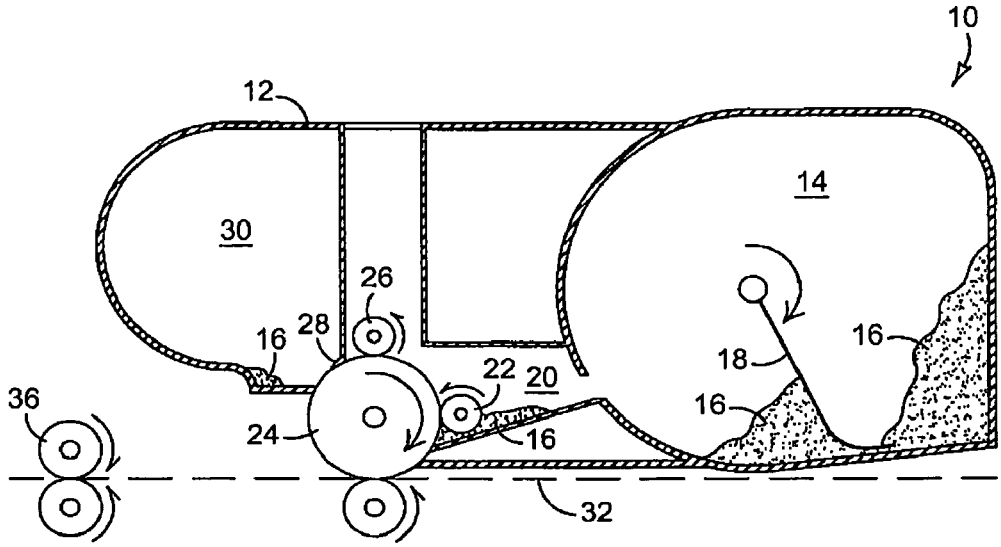
FIG. 1 is a cross sectional view of an exemplary imaging cartridge in which various embodiments of the present invention may be implemented.

FIG. 1 is a cross sectional view of an exemplary imaging cartridge 10 in which embodiments of the present invention can be implemented. As shown imaging cartridge 10 is a toner cartridge configured to be inserted into an electrophotographic imaging device. Cartridge 10 includes housing 12 that defines reservoir 14, imaging material in the form of toner 16, agitator 18, hopper 20, application roller 22, photoconductive drum 24, charge roller 26, wiper 28, and waste storage area 30.

Reservoir 14 represents a cavity for holding a supply of toner 16. Agitator 18 is shown as a paddle that rotates, at the urging of an imaging device, within reservoir 14 to stir or "fluff" toner 16. During a printing process, toner 16 egresses reservoir 14 to hopper 20. Application roller 22 applies toner 16 from hopper 20 to photoconductive drum 24 which has been charged by charge roller 26. Wiper 28 removes residual toner from photoconductive drum 24. The residual toner is held in waste storage area 30.

In operation, light from a laser (not shown) is scanned across charged photoconductive drum 24 in a pattern of a desired print image. Where exposed to the light, photoconductive drum 24 is discharged creating an electrostatic version of the desired print image. Application roller 22 transfers toner particles to photoconductive drum 24. The toner particles are repelled by the charged portions of photoconductive drum 24 but adhere to the discharged portions. As media sheet 32 passes across photoconductive drum 24 toner particles are then transferred from photoconductive drum 24 to media sheet 32. Fuser rollers 36 supplied by the imaging device, thermally fix the transferred toner particles to media sheet 32.

Fixed Status Indicator

Figure 2:
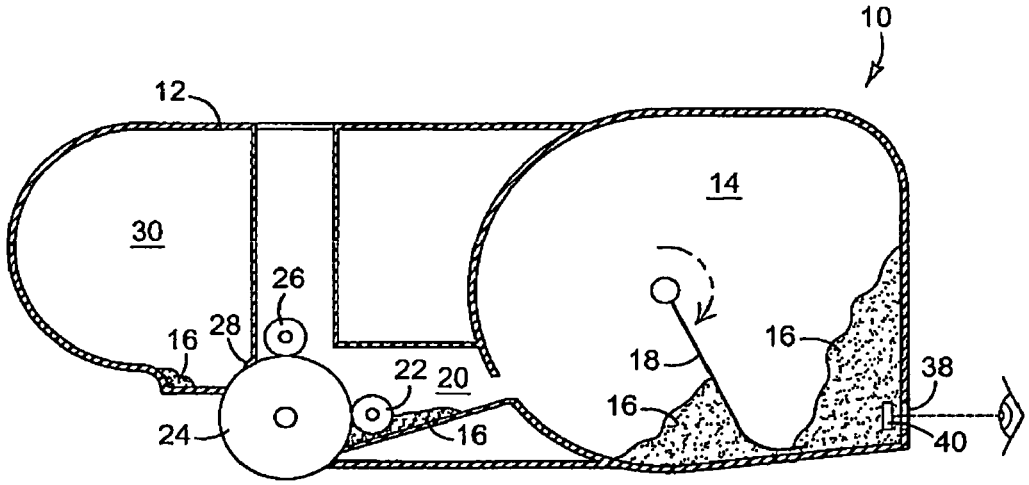
FIG. 2 is a cross sectional view of an imaging cartridge having an exemplary status indicator blocked by imaging material according to an embodiment of the present invention.
Figure 3:
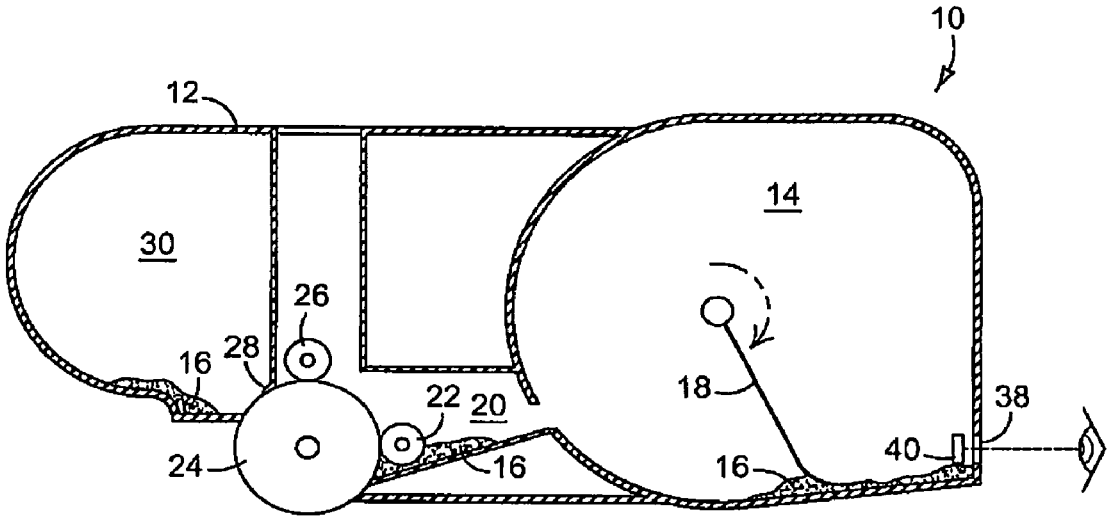
FIG. 3 is a cross sectional view of the imaging cartridge of FIG. 2 in which a substantial portion of the imaging material has been consumed revealing the status indicator according to an embodiment of the present invention.

In FIGS. 2 and 3, imaging cartridge 10 incorporates indicator window 38 and status indicator 40. Indicator window 38 represents a transparent or semi-transparent material that keeps toner 16 sealed within housing 12, but provides a view into reservoir 14. Status indicator 40 represents generally any body with a fixed position within reservoir 14. Status indicator 40 is positioned so that when cartridge 10 contains a sufficient amount of toner 16, that toner 16 blocks status indicator 40 from view of indicator window 38. In this example, status indicator 40 is configured to be made visible following the consumption of at least a substantial amount of toner 16.

An imaging device utilizing cartridge 10 consumes toner 16 to produce printed images. Once a substantial portion of the toner 16 has been consumed, as in FIG. 3, toner 16 no longer blocks status indicator 40 from view of indicator window 38. The sight of status indicator 40 can provide a clear signal to a consumer or retailer that the useful life of cartridge 10 has expired and that cartridge 10 is out of warranty.

Resilient Status Indicator

Figure 4:
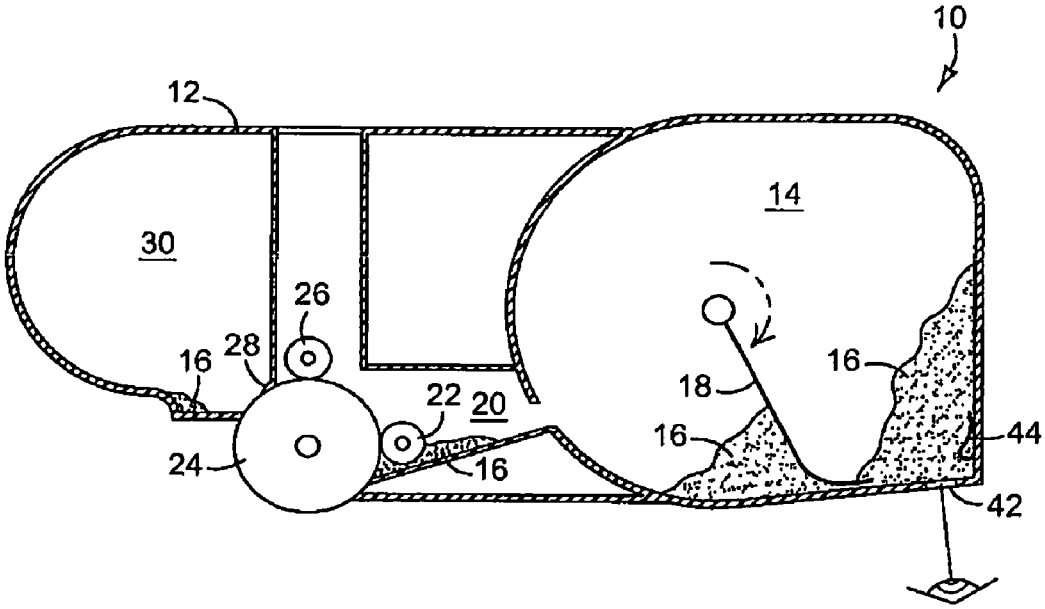
FIG. 4 is a cross sectional view of an imaging cartridge having an exemplary resilient status indicator held in a flexed position by imaging material according to an embodiment of the present invention.
Figure 5:
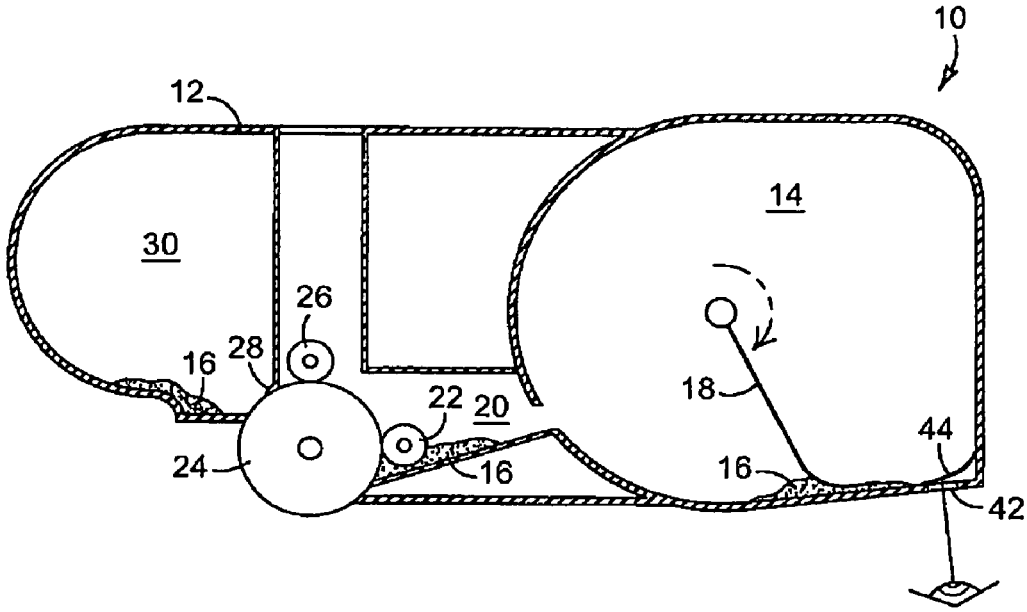
FIG. 5 is a cross sectional view of the imaging cartridge of FIG. 4 in which the resilient status indicator has been released after a substantial portion of the imaging material has been consumed according to an embodiment of the present invention.

In FIGS. 4 and 5, imaging cartridge 10 incorporates indicator window 42 and status indicator 44. Indicator window 42 represents a transparent or semi-transparent material that keeps toner 16 sealed within housing 12, but provides a view into reservoir 14. Status indicator 44 represents generally a resilient body that can be held in a flexed position outside the view of indicator window 42, and when released, moves into view of indicator window 42. In this example, status indicator 44 is configured to be made visible following the consumption of at least a substantial amount of toner 16. Status indicator 44, could instead be held in the flexed position by a latch or other means not directly related to toner 16. Upon a triggering event, the latch could be released allowing status indicator 44 to be position in view of indicator window 42.

As shown in FIG. 4, when cartridge 10 contains a sufficient amount of toner 16, that toner 16 holds status indicator 44 in a flexed position out of view of indicator window 42. Once a substantial portion of the toner 16 has been consumed, as in FIG. 5, no longer holds status indicator 44, and status indicator 44 is released into view of indicator window 42. The sight of status indicator 44 can provide a clear signal to a consumer or retailer that the useful life of cartridge 10 has expired and that cartridge 10 is out of warranty.

Combined Agitator and Status Indicator

In FIGS. 6-9, imaging cartridge 10 incorporates indicator window 50, status indicator 52 formed as part of agitator 18, and wedge 54. Indicator window 50 represents a transparent or semi-transparent material that keeps toner 16 sealed within housing 12, but provides a view into reservoir 14. Agitator 18 includes a resilient paddle with a first side 46 and a second side 48. Status indicator 52 is formed on second side 48 of that paddle. Wedge 54 is formed on an inside wall of reservoir 14.

Figure 6:
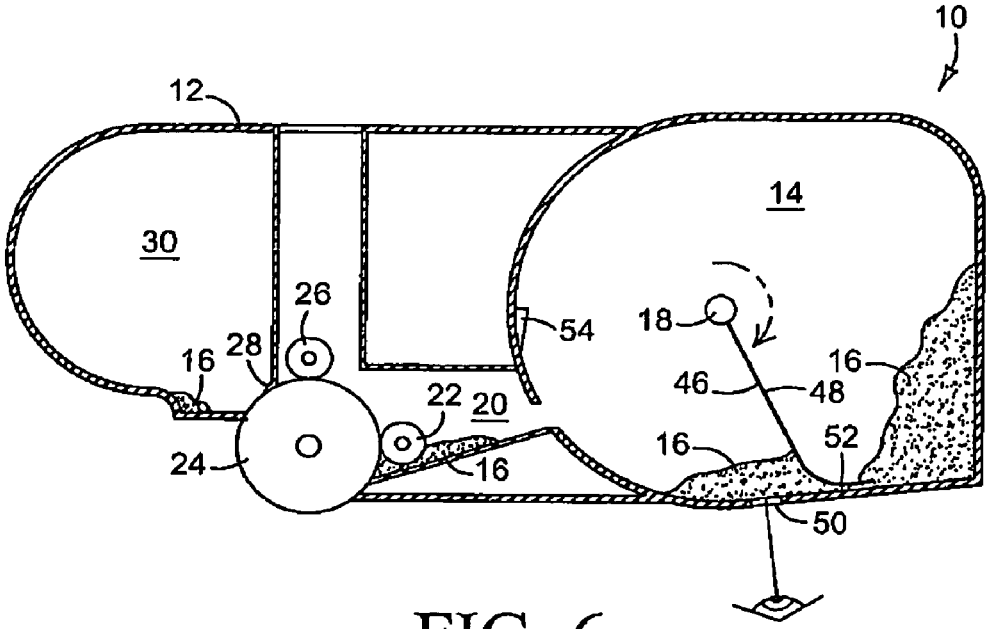
FIGS. 6-9 are cross sectional views of an imaging cartridge in which an end of life indicator in incorporated as part of an agitator according to an embodiment of the present invention.
Figure 7:
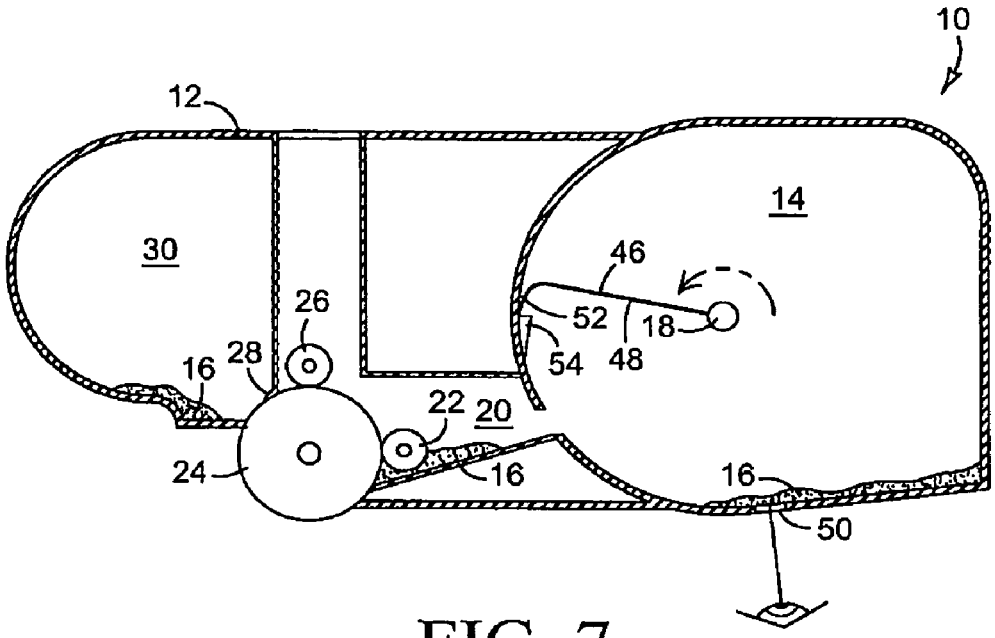

During normal operation, agitator 18, at the urging of an imaging device, rotates in a clockwise fashion as shown in FIG. 6. The clockwise rotation causes a portion of first side 46 to press against the inside surface of reservoir 14. Wedge 54 is positioned and oriented as to minimally impact the clockwise rotation of agitator 18 as first surface 46 slides over wedge 54. Following a triggering event the rotation of agitator 18 is reversed at the urging of the imaging device and is caught by wedge 54.

Figure 8:
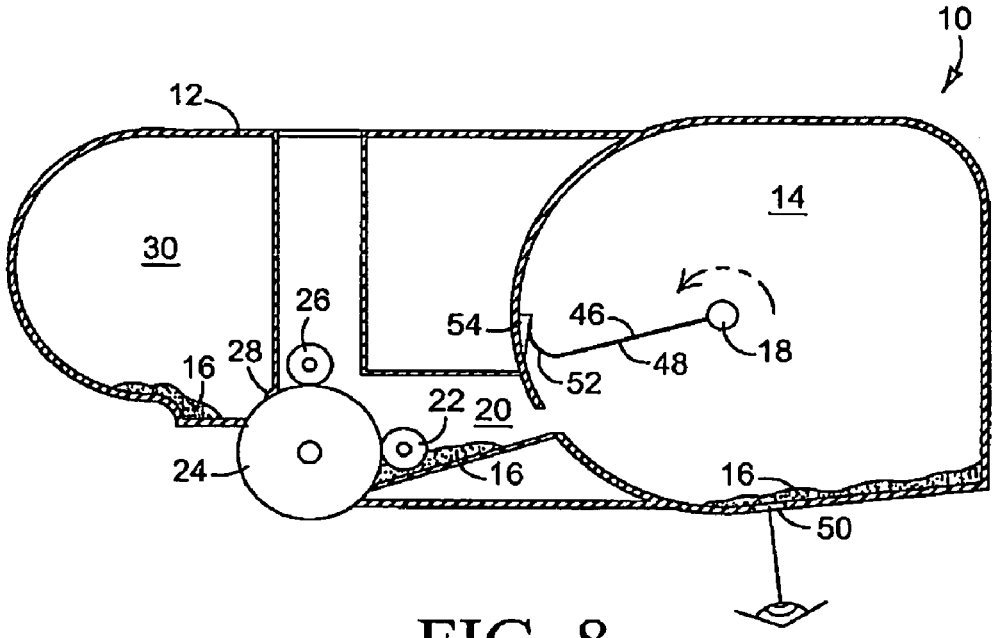
Figure 9:
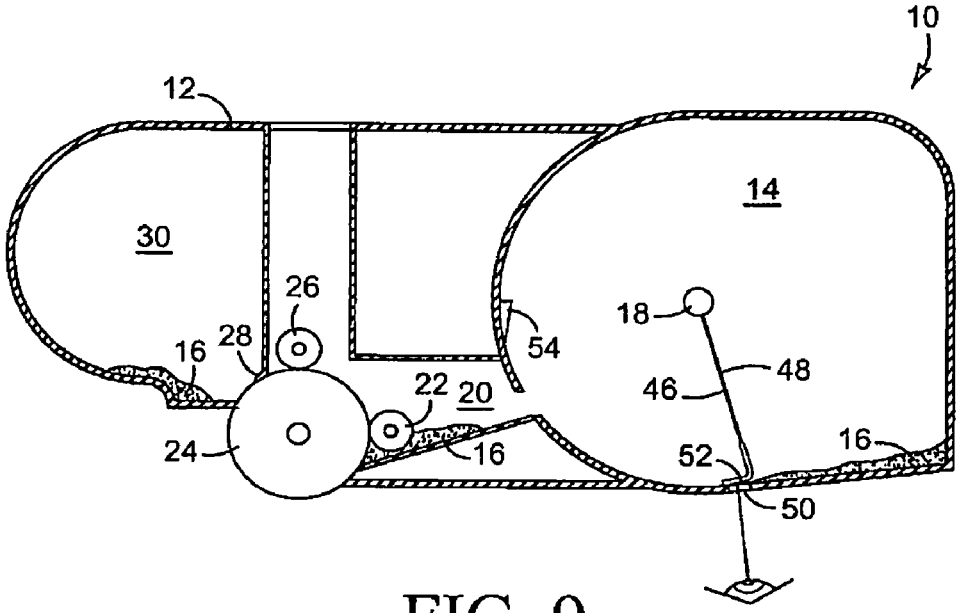

In FIG. 8, the continued counter-clockwise rotation of agitator 18 while in contact with wedge 54 causes a portion of second side 48 to face the inside surface of reservoir 14. Status indicator 52 is formed on that portion of second side 48. The counter-clockwise rotation of agitator 18 is continued until status indicator 52 is positioned within view of indicator window 50. The sight of status indicator 52 can provide a clear signal to a consumer or retailer that the useful life of cartridge 10 has expired and that cartridge 10 is out of warranty.

Status indicator 52 may include a number of distinct status indicators each representing a different status of imaging cartridge 10. Following a first triggering event (the consumption of a substantial amount of toner 16, for example) agitator 18 may be rotated counter-clockwise until the particular status indicator corresponding to the first triggering event is visible though indicator window 50. Following a different triggering event, agitator 18 may be rotated counter-clockwise until a different status indicator corresponding to that triggering event is visible though indicator window 50. As noted above, different triggering events can include but are not limited to the use of cartridge 10 to print a set number of pages or the use of a component of cartridge 10 through a set number of cycles.

Moveable Status Indicator

Figure 10:
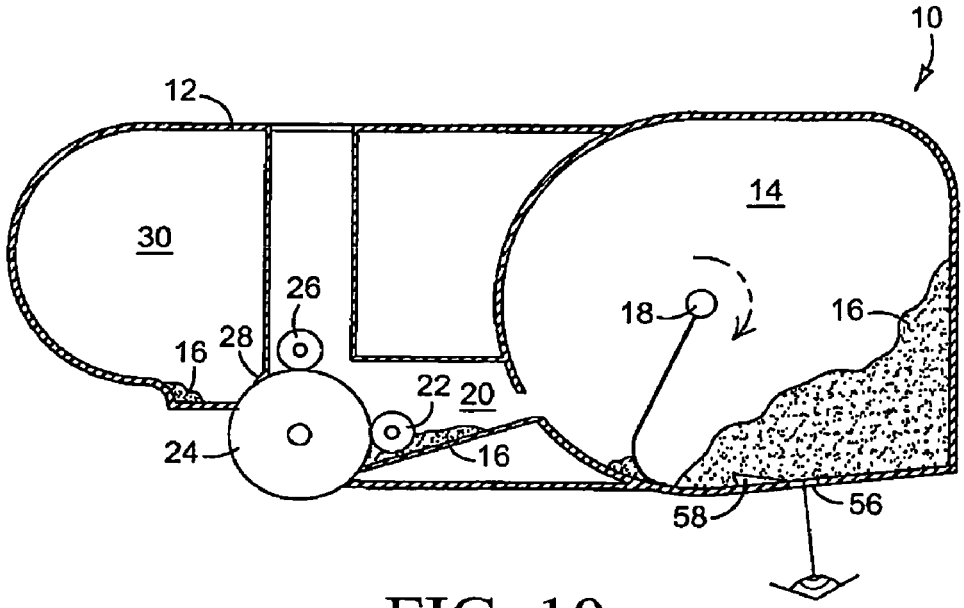
FIGS. 10-12 are a cross sectional view of an imaging cartridge in which an status indicator is moved from a first position to a second position once a substantial portion of the cartridge's imaging material has been consumed according to an embodiment of the present invention.
Figure 11:
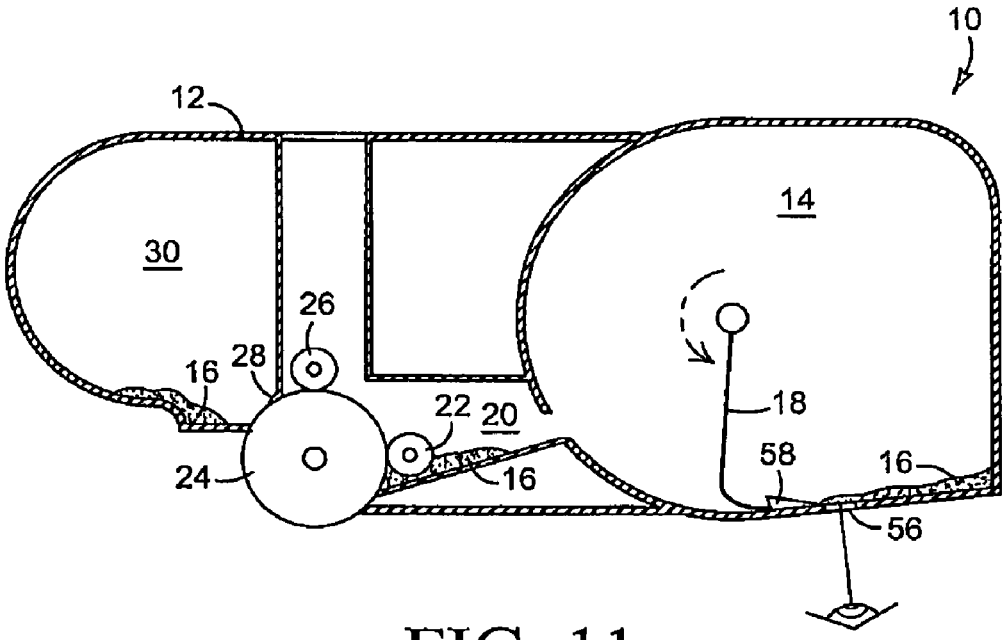
Figure 12:
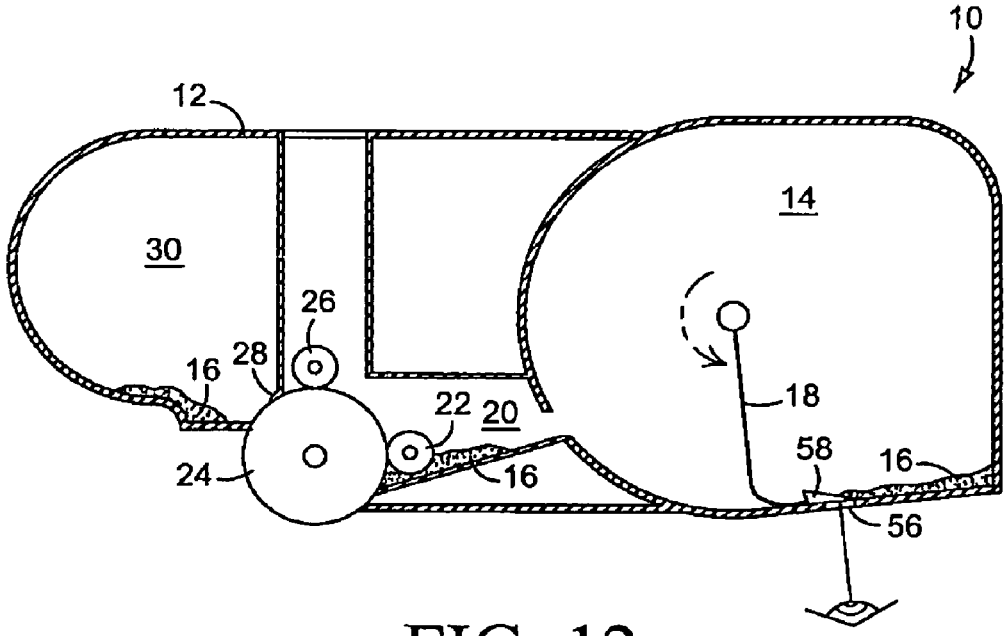

In FIGS. 10-12, imaging cartridge 10 incorporates indicator window 56 and status indicator 58. Indicator window 56 represents a transparent or semi-transparent material that keeps toner 16 sealed within housing 12, but provides a view into reservoir 14. In this example, status indicator 58 is a wedge shaped moveable body. During normal operation, status indicator 58 is held in a first position outside of the view of indicator window 56. Status indicator 58 is oriented so that the normal, clock-wise rotation of agitator 18 is minimally affected with agitator 18 sliding over status indicator 58.

Following a triggering event, the rotation of agitator 18 is reversed contacting status indicator 58. The continued counter-clockwise rotation of agitator 18 while in contact with end-of life-indicator 58 urges end-of life-indicator 58 to a second position within view of indicator window 56. The sight of status indicator 58 can provide a clear signal to a consumer or retailer that the useful life of cartridge 10 has expired and that cartridge 10 is out of warranty.

As above with status indicator 52, status indicator 58 may include a number of distinct status indicators each representing a different status of imaging cartridge 10. Status indicator 58 may then be moveable between more that two positions. For example, following a first triggering event (the consumption of a substantial amount of toner 16, for example) agitator 18 may be rotated counter-clockwise until the particular status indicator corresponding to the first triggering event is visible though indicator window 56. Following a different triggering event, agitator 18 may be rotated counter-clockwise until a different status indicator corresponding to that triggering event is visible though indicator window 56.

Status Indicators

Figure 13A:
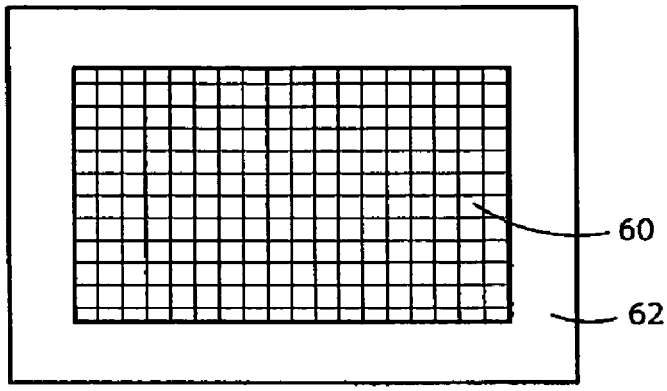
FIGS. 13A-13C are views of exemplary status indicators according to embodiments of the present invention.
Figure 13B:
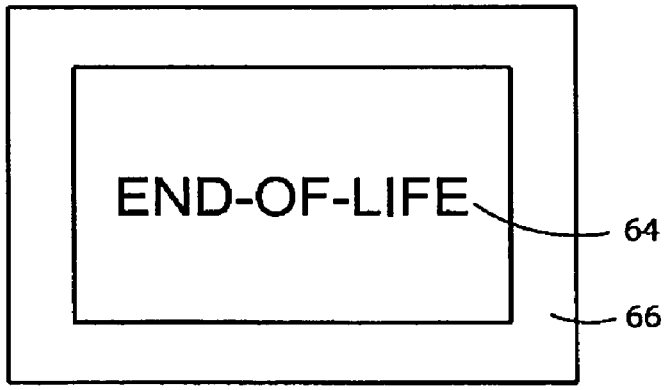
Figure 13C:
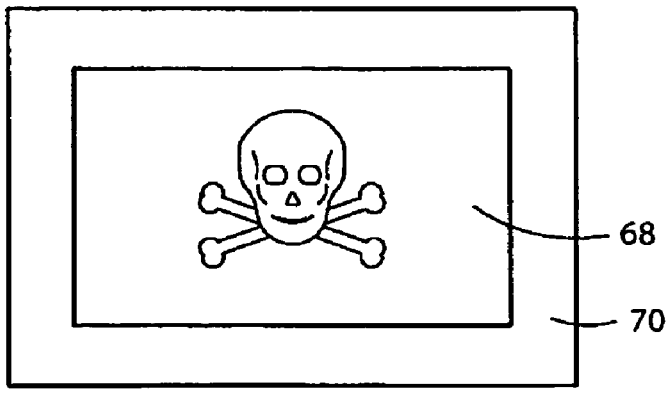

FIGS. 13A-13C illustrate exemplary status indicators that might be used in the various embodiments described above. In FIG. 13A status indicator 60 includes a bright, solid color visible through indicator window 62. In FIG. 13B status indicator 64 includes text visible through indicator window 66. In FIG. 13C status indicator 68 is an icon visible through indicator window 70. Nonetheless, end-of life indicators (referenced as 40, 44, 52, and 58 in FIGS. 2-12) need only include a visible indicator that can serve as signal that a an imaging cartridge has been used up.

CONCLUSION

FIGS. 2-13C illustrate various embodiments of the present invention. The figures illustrate various implementations of an imaging cartridge with an status indicator and its use. While the present invention has been shown and described with reference to the foregoing exemplary embodiments, it is to be understood that other forms, details, and embodiments may be made without departing from the spirit and scope of the invention which is defined in the following claims.

What is claimed is:

1. An imaging cartridge, comprising:

a housing having a reservoir for holding a supply of imaging material, the housing insertable into an imaging device;

an indicator window; and a status indicator contained within the housing and configured to be made visible, from within the housing, through the indicator window following a triggering event;

wherein the status indicator is a status indicator selected from a group consisting of:

a status indicator that, prior to the triggering event, is blocked from being visible though the indicator window by the imaging material, the triggering event including consumption of at least a substantial amount of the imaging material to reveal the status indicator:

a status indicator integrated into a paddle, wherein the imaging material is toner and the cartridge comprises a toner agitator that includes the paddle; and a resilient body configured to be held by the imaging material in a flexed position outside the view of the indicator window and released into view of the indicator window once at least a substantial portion of the imaging material has been consumed.

2. The imaging cartridge of claim 1, wherein the paddle comprises a first side for agitating the toner and a second side that includes the status indicator.

3. The imaging cartridge of claim 2, wherein the paddle is rotatable in a first direction and a second direction, wherein rotation in the first direction agitates the toner and rotation in the second direction positions the status indicator within view of the indicator window.

4. An imaging cartridge, comprising:

a housing having a reservoir for holding a supply of imaging material, the housing insertable into an imaging device;

an indicator window; and a plurality of status indicators contained within the housing wherein each status indicator is configured to be made visible, from within the housing, through the indicator window following a corresponding triggering event;

wherein the status indicators are status indicators selected from a group consisting of:

status indicators that, prior to the triggering event, are blocked from being visible though the indicator window by the imaging material, the triggering event including consumption of at least a substantial amount of the imaging material to reveal the status indicators;

status indicators integrated into a paddle, wherein the imaging material is toner and the cartridge comprises a toner agitator that includes the paddle; and resilient bodies configured to be held by the imaging material in a flexed position outside the view of the indicator window and released into view of the indicator window once at least a substantial portion of the imaging material has been consumed.

5. An imaging cartridge, comprising:

a housing having a means for supplying imaging material, the housing insertable into an imaging device;

an indicator window; and a means for revealing a status indicator, from within the housing, through the indicator window following a triggering event;

wherein the status indicator is a status indicator selected from a group consisting of:

a status indicator that, prior to the triggering event, is blocked from being visible though the indicator window by the imaging material, the triggering event including consumption of at least a substantial amount of the imaging material to reveal the status indicator;

a status indicator integrated into a paddle, wherein the imaging material is toner and the cartridge comprises a toner agitator that includes the paddle; and a resilient body configured to be held by the imaging material in a flexed position outside the view of the indicator window and released into view of the indicator window once at least a substantial portion of the imaging material has been consumed.

6. A method for indicating the status of an imaging cartridge, comprising:

providing within a housing, an indicator window and a reservoir for supplying imaging material, the housing being insertable in to an imaging device;

the imaging device consuming the imaging material; and revealing a status indicator, from within the housing, through the indicator window following a triggering event;

wherein the status indicator is a status indicator selected from a group consisting of:

a status indicator that, prior to the triggering event, is blocked from being visible though the indicator window by the imaging material, the triggering event including consumption of at least a substantial amount of the imaging material to reveal the status indicator;

a status indicator integrated into a paddle, wherein the imaging material is toner and the cartridge comprises a toner agitator that includes the paddle; and a resilient body configured to be held by the imaging material in a flexed position outside the view of the indicator window and released into view of the indicator window once at least a substantial portion of the imaging material has been consumed.

7. The method of claim 6, wherein the status indicator is the status indicator that, prior to the triggering event, is blocked from being visible though the indicator window by the imaging material and revealing comprises the imaging material preventing the status indicator from being seen through the indicator window until at least the substantial portion has been consumed.

8. The method of claim 6, wherein the status indicator is the status indicator integrated into the paddle and revealing comprises stationing the paddle in view of the indicator window following the triggering event.

9. The method of claim 8, wherein the paddle comprises a first side for agitating the toner and a second side that includes the end-of life indicator, the paddle being rotatable in a first direction and a second direction, wherein rotation in the first direction agitates the toner, and wherein revealing comprises rotating the paddle in the second direction until the status indicator is positioned within view of the indicator window.

10. The method of claim 6, wherein the status indicator is the resilient body and, revealing comprises releasing the status indicator into view of the indicator window following the triggering event.

11. The method of claim 6, wherein revealing comprises, following the triggering event revealing a status indicator corresponding to that triggering through the indicator window, the status indicator being one of a plurality of status indicators.

12. A status indicator system for an imaging cartridge having a reservoir supplying imaging material, comprising:

an indicator window; and a status indicator contained within the reservoir and configured to be made visible, from within the reservoir, through the indicator window following a triggering event;

wherein the status indicator is a status indicator selected from a group consisting of:

a status indicator that, prior to the triggering event, is blocked from being visible though the indicator window by the imaging material, the triggering event including consumption of at least a substantial amount of the imaging material to reveal the status indicator;

a status indicator integrated into a paddle, wherein the imaging material is toner and the cartridge comprises a toner agitator that includes the paddle; and a resilient body configured to be held by the imaging material in a flexed position outside the view of the indicator window and released into view of the indicator window once at least a substantial portion of the imaging material has been consumed.

13. The system of claim 12, wherein the paddle includes a first side for agitating the toner and a second side that includes the end-of life indicator.

14. The system of claim imaging 13, wherein the paddle is rotatable in a first direction and a second direction, wherein rotation in the first direction agitates the toner and rotation in the second direction positions the status indicator within view of the indicator window.

15. A status indicator system for an imaging cartridge having a reservoir supplying imaging material, comprising:

an indicator window; and a plurality of status indicators contained within the reservoir, each status indicator being configured to be made visible, from within the reservoir, through the indicator window following a corresponding triggering event;

wherein the status indicators are status indicators selected from a group consisting of:

status indicators that, prior to the triggering event, are blocked from being visible though the indicator window by the imaging material, the triggering event including consumption of at least a substantial amount of the imaging material to reveal the status indicators;

status indicators integrated into a paddle, wherein the imaging material is toner and the cartridge comprises a toner agitator that includes the paddle; and resilient bodies configured to be held by the imaging material in a flexed position outside the view of the indicator window and released into view of the indicator window once at least a substantial portion of the imaging material has been consumed.

* * * * *

UNITED STATES PATENT AND TRADEMARK OFFICE

CERTIFICATE OF CORRECTION

PATENT NO. : 7,352,976 B2
APPLICATION NO. : 10/977310
DATED : April 1, 2008
INVENTOR(S) : Debbie A. Balch et al.

It is certified that error appears in the above-identified patent and that said Letters Patent is hereby corrected as shown below:

In column 5, line 21, in Claim 1, after "indicator" delete ":" and insert -- ; --, therefor.

In column 6, line 65, in Claim 10, after "and" delete ",".

In column 8, line 1, in Claim 14, after "claim" delete "imaging".

Signed and Sealed this

Ninth Day of September, 2008

JON W. DUDAS
*Director of the United States Patent and Trademark Office*